United States Patent [19]

Herbst et al.

[11] Patent Number: 4,861,741

[45] Date of Patent: Aug. 29, 1989

[54] MIXED CATALYST SYSTEM AND CATALYTIC CONVERSION PROCESS EMPLOYING SAME

[75] Inventors: Joseph A. Herbst, Turnersville; Hartley Owen, Belle Mead, both of N.J.; Paul H. Schipper, Wilmington, Del.

[73] Assignee: Mobil Oil Corporation, New York, N.Y.

[21] Appl. No.: 153,522

[22] Filed: Feb. 8, 1988

Related U.S. Application Data

[63] Continuation-in-part of Ser. No. 903,311, Sep. 3, 1986, abandoned.

[51] Int. Cl.[4] ..... B01J 29/06; B01J 29/08

[52] U.S. Cl. ..... 502/67; 502/63; 502/77; 502/79; 208/120

[58] Field of Search ..... 208/120, 67, 113; 502/67, 63, 77, 79

[56] References Cited

U.S. PATENT DOCUMENTS

| | | | |
|---|---|---|---|
| 3,617,497 | 11/1971 | Bryson et al. | 208/80 |
| 3,748,251 | 7/1973 | Demmel et al. | 208/74 |
| 3,849,291 | 11/1974 | Owen | 208/78 |
| 3,894,931 | 7/1975 | Nace et al. | 208/73 |
| 3,894,932 | 7/1975 | Owen | 208/74 |
| 3,894,933 | 7/1975 | Owen et al. | 208/77 |
| 3,894,934 | 7/1975 | Owen et al. | 208/78 |
| 3,894,935 | 7/1975 | Owen | 208/78 |
| 3,926,778 | 12/1975 | Owen et al. | 208/74 |
| 3,928,172 | 12/1975 | Davis, Jr. et al. | 208/77 |
| 3,974,062 | 8/1976 | Owen et al. | 208/74 |
| 4,116,814 | 9/1978 | Zahner | 208/78 |
| 4,287,088 | 9/1981 | Sirkar | 208/52.08 |
| 4,309,279 | 1/1982 | Chester et al. | 208/120 |
| 4,361,114 | 1/1983 | Chester et al. | 208/120 |
| 4,430,200 | 2/1984 | Shihabi | 208/111 |
| 4,483,760 | 11/1984 | Tabak et al. | 208/70 |
| 4,486,296 | 12/1984 | Oleck et al. | 208/111 |
| 4,490,241 | 12/1984 | Chou | 208/75 |
| 4,541,919 | 8/1984 | LaPierre et al. | 208/111 |
| 4,552,648 | 11/1985 | Rosinski et al. | 208/120 |
| 4,717,466 | 1/1988 | Herbst et al. | 208/113 |
| 4,749,470 | 6/1988 | Herbst et al. | 208/85 |
| 4,752,375 | 6/1988 | Herbst et al. | 208/74 |

*Primary Examiner*—Anthony McFarlane

*Attorney, Agent, or Firm*—Alexander J. McKillop; Charles J. Speciale; Marina V. Schneller

[57] ABSTRACT

A mixed catalyst system is disclosed which comprises particles of a first, component which requires frequent regeneration in a catalyst regeneration zone and particles of a second catalyst component which is less coke deactivated than the first catalyst component and requires less frequent regeneration than the latter, there being a sufficient difference between one or more of the characterizing physical properties of each catalyst component that the rate of circulation of particles of second catalyst component through the regeneration zone is, on the average, less than that of particles of first catalyst component.

25 Claims, 1 Drawing Sheet

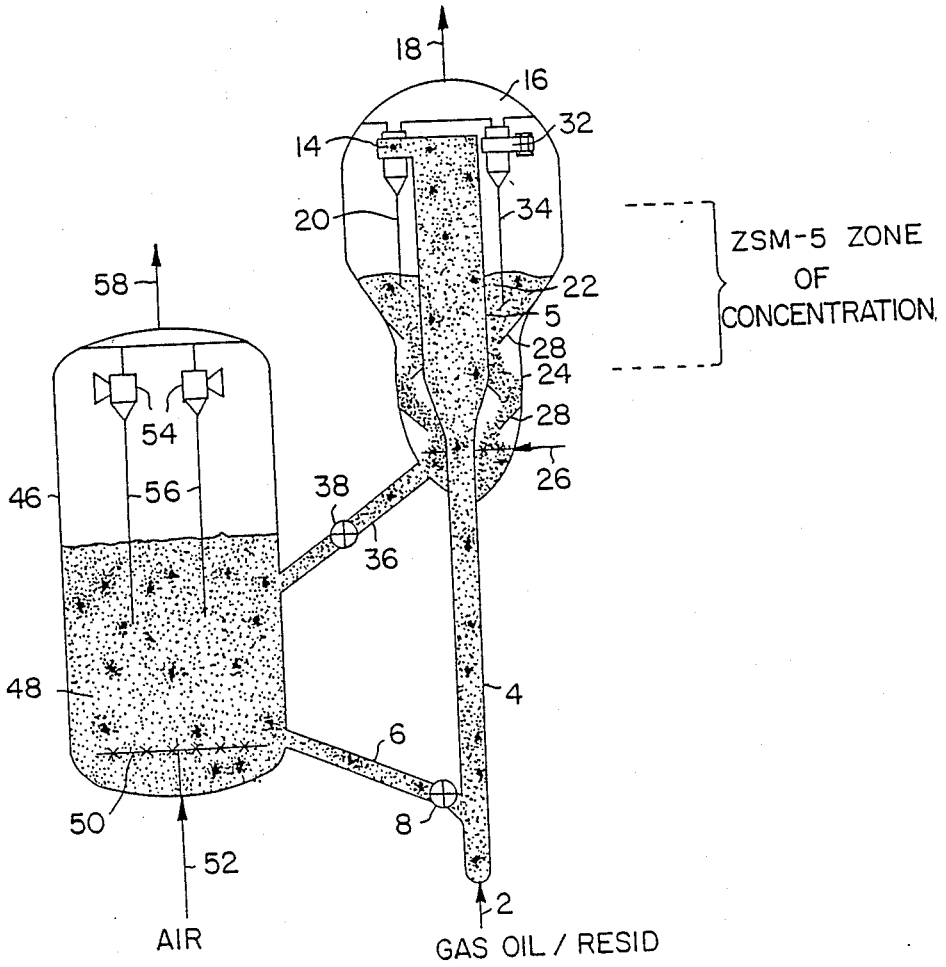
18
16
32
14
20
34
ZSM-5 ZONE
OF
CONCENTRATION
58
22
5
28
24
28
26
54
46
56
38
36
48
4
6
50
8
52
2
AIR
GAS OIL / RESID

MIXED CATALYST SYSTEM AND CATALYTIC CONVERSION PROCESS EMPLOYING SAME

This is a continuation-in-part of copending application Ser. No. 903,311, filed on Sept. 3, 1986 now abandoned.

BACKGROUND OF THE INVENTION

This invention relates to a catalyst composition comprising at least two catalyst components possessing distinctly different catalytic properties and to a method of providing such a catalyst composition to a catalytic conversion process associated with a catalyst regeneration zone, in particular, a catalytic cracking process.

In known and conventional fluidized catalytic cracking processes, a relatively heavy hydrocarbon feedstock, e.g., a gas oil, admixed with a suitable cracking catalyst, e.g., a large pore crystalline silicate zeolite such as zeolite Y, to provide a fluidized suspension is cracked in an elongated reactor, or riser, at elevated temperature to provide a mixture of lighter hydrocarbon products. The gasiform reaction products and spent catalyst are discharged from the riser into a separator, e.g., a cyclone unit, located within the upper section of an enclosed stripping vessel, or stripper, with the reaction products being conveyed to a product recovery zone and the spent catalyst entering a dense catalyst bed within the lower section of the stripper. In order to remove entrained hydrocarbon product from the spent catalyst prior to conveying the latter to a catalyst regenerator unit, an inert stripping gas, e.g., steam, is passed through the catalyst where it desorbs such hydrocarbons conveying them to the product recovery zone. The fluidized catalyst is continuously circulated between the riser and the regenerator and serves to transfer heat from the latter to the former thereby supplying the thermal needs of the cracking reaction which is endothermic.

Particular examples of such catalytic cracking processes are disclosed in U.S. Pat. Nos. 3,617,497, 3,894,932, 4,309,279 and 4,368,114 (single risers) and U.S. Pat. Nos. 3,748,251, 3,849,291, 3,894,931, 3,894,933, 3,894,934, 3,894,935, 3,926,778, 3,928,172, 3,974,062 and 4,116,814 (multiple risers).

Several of these processes employ a mixture of catalysts having different catalytic properties as, for example, the catalytic cracking process described in U.S. Pat. No. 3,894,934 which utilizes a mixture of a large pore crystalline silicate zeolite cracking catalyst such as zeolite Y and shape selective medium pore crystalline silicate zeolite such as ZSM-5. Each catalyst contributes to the function of the other to produce a gasoline product of relatively high octane rating.

In this and other fluidized catalytic cracking operations employing mixtures of large and medium pore size crystalline silicate zeolite catalysts where catalyst separated from the product effluent is conveyed to a stripper and from there to a catalyst regenerating zone, regardless of the nature of the catalyst introduction at start-up, once steady-state operation has been achieved, the two types of catalyst will become fairly uniformly mixed and will circulate throughout the system at or about the same rate. This arrangement is subject to a significant disadvantage. While the large pore zeolite cracking catalyst cokes up relatively quickly and must therefore be regenerated at frequent intervals, this is not the case with the medium pore zeolite catalyst which can maintain their catalytic activity over many more cycles of operation. However, since the large and medium pore zeolite catalysts are in intimate admixture, heretofore there has been no practical means of conveying only the large pore zeolite catalyst to the catalyst regenerator unit or, what amounts to the same thing, keeping the medium pore zeolite catalyst, or at least most of it, on the average out of the regenerator.

Thus, a principal disadvantage resulting from the use of mixed catalyst systems in known fluidized catalytic cracking operations is owing to the fact that the medium pore zeolite catalyst component is subjected to the harsh hydrothermal conditions of the catalyst regenerator unit even though it does not require regeneration anywhere near the rate at which the large pore zeolite cracking component must be regenerated. The medium pore zeolite catalyst is therefore needlessly subjected to hydrothermal deactivation at a much greater rate than is necessary for it to function.

U.S. Pat. No. 4,116,814 describes a multiple riser fluidized catalytic cracking operation utilizing a mixture of large and medium pore crystalline zeolite catalysts which differ in particle size and/or density as to facilitate their separation in a common catalyst regeneration unit. There is, however, no hint in this patent of preventing the transfer or reducing the rate of circulation of medium pore crystalline zeolite to and through the catalyst regeneration unit.

U.S. Pat. No. 4,287,088 describes a process and system for the segregation of used contaminated catalyst into fractions according to particle density differences. No mention is made of mixed catalyst systems.

SUMMARY OF THE INVENTION

It is an object of the present invention to provide a mixed catalyst system for use in a hydrocarbon conversion process featuring a catalyst regeneration operation wherein one of the catalyst components requires less frequent regeneration than the other catalyst component, the rate of circulation of the former catalyst through the catalyst regeneration zone being substantially less than that of the latter.

It is another object of the invention to provide a mixed catalyst system comprising an amorphous and/or large pore crystalline cracking catalyst component and a shape selective medium pore crystalline silicate zeolite catalyst component, the density, size and/or shape of the particles of each of said catalyst components being sufficiently different as to provide a significant differential in the settling rate thereof, the differential settling rate of the catalysts resulting in a rate of circulation of said medium pore crystalline silicate zeolite catalyst through the catalyst regeneration zone which is substantially less than that of the amorphous and/or large pore crystalline cracking catalyst.

It is a further object of the invention to provide a hydrocarbon conversion process featuring a catalyst regeneration operation and the use of a mixed catalyst system wherein one of the catalyst components requires less frequent regeneration than the other catalyst component, the rate of circulation of the former catalyst through the catalyst regeneration zone being substantially less than that of the latter.

It is still a further object of the invention to provide a fluidized catalytic cracking process featuring a catalyst regeneration operation and a mixed catalyst system comprising an amorphous and/or large pore crystalline cracking catalyst component and a shape selective medium pore crystalline silicate zeolite catalyst component, the density, size and/or shape of the particles of each of said catalyst components being sufficiently different as to provide a significant differential in the settling rate thereof, the differential settling rate of the catalysts resulting in a rate of circulation of said medium pore zeolite catalyst through the catalyst regeneration zone which is substantially less than that of the amorphous and/or large pore crystalline cracking catalyst.

In keeping with the foregoing objects, there is provided a mixed catalyst system which comprises particles of a first, relatively hydrothermally stable catalyst component which requires frequent regeneration in a hydrothermal catalyst regeneration zone and particles of a second catalyst component which is less coke deactivated than the first catalyst component and requires less frequent regeneration than the latter, there being a sufficient difference between one or more of the characterizing physical properties of each catalyst component that the rate of circulation of particles of second catalyst component through the regeneration zone is, on the average, less than that of particles of first catalyst component.

The term "catalyst" as used herein shall be understood to apply not only to a catalytically active material but to one which is composited with a suitable matrix component which may or may not itself be catalytically active.

The foregoing mixed catalyst system does much to overcome a major drawback of known and conventional mixed catalyst systems in which both catalyst components circulate through the catalyst regeneration zone at about the same rate. As applied, for example, to a fluidized catalytic cracking process in which a cracking catalyst requiring frequent regeneration such as zeolite Y is employed in combination with a shape selective medium pore crystalline silicate zeolite catalyst requiring comparatively infrequent regeneration such as ZSM-5, the present invention makes it possible to sustain relatively high levels of activity of the latter catalyst for much longer average periods than would otherwise be the case due to the reduced incidence of its exposure to the catalyst-degrading environment of the regenerator zone. This, in turn, permits the refiner to take greater advantage of the unique catalytic capabilities of ZSM-5 in a catalytic cracking operation.

BRIEF DESCRIPTION OF THE DRAWING

The attached FIGURE of drawing illustrates a fluidized catalytic cracking operation carried out in a fluidized cracking unit possessing a flared riser.

DESCRIPTION OF THE PREFERRED EMBODIMENTS

Although the present invention is generally applicable to any mixed catalyst system comprising a catalyst component requiring frequent regeneration and a catalyst component which does not require frequent regeneration including a combination of two or more of either or both such types of catalyst components, and applies to any hydrocarbon conversion process employing such a catalyst system, it will be more particularly described in connection with a mixed catalyst system containing a large pore crystalline silicate zeolite cracking catalyst component which requires frequent regeneration and a shape selective medium pore crystalline silicate zeolite catalyst component which requires regeneration only after relatively long periods in service, such catalyst system being specifically illustrated in connection with a cracking operation.

Conventional cracking catalyst components are generally amorphous silica-alumina and crystalline silica-alumina. Other materials said to be useful as cracking catalysts are the crystalline silicoaluminophosphates of U.S. Pat. No. 4,440,871 and the crystalline metal aluminophosphates of U.S. Pat. No. 4,567,029.

However, the major conventional cracking catalysts presently in use generally comprise a large pore crystalline silicate zeolite, generally in a suitable matrix component which may or may not itself possess catalytic activity. These zeolites typically possess an average crystallographic pore dimension of about 7.0 Angstroms and above for their major pore opening. Representative crystalline silicate zeolite cracking catalysts of this type include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), merely to name a few, as well as naturally occurring zeolites, such as chabazite, faujasite, mordenite, and the like. Also useful are the silicon-substituted zeolites described in U.S. Pat. No. 4,503,023. Zeolite Beta is yet another large pore crystalline silicate which can constitute a component of the mixed catalyst system herein.

It is, of course, within the scope of this invention to employ two or more of the foregoing amorphous and/or large pore crystalline cracking catalysts. It is further contemplated that the mixed catalyst system can be made up solely of two or more amorphous and/or large pore crystalline silicate cracking catalysts provided at least one catalyst requires frequent regeneration and another catalyst in the system needs regeneration only on a relatively infrequent basis. Thus, for example, a mixed catalyst system in accordance with the invention can be made up of zeolite Y, a catalyst which requires frequent regeneration but is fairly stable under the conditions prevailing in the regenerator, and zeolite Beta, a catalyst which need not be regenerated as frequently as zeolite Y and then is needlessly subjected to degradation under the harsh conditions characteristic of most regenerating operations. Preferred large pore crystalline silicate zeolite components of the mixed catalyst composition herein include the synthetic faujasite zeolites X and Y with particular preference being accorded zeolites Y, REY, USY and RE-USY.

The shape selective medium pore crystalline silicate zeolite catalyst is exemplified by ZSM-5, ZSM-11, ZSM-12, ZSM-23, ZSM-35, ZSM-38, ZSM-48 and other similar materials. U.S. Pat. No. 3,702,886 describing and claiming ZSM-5 is incorporated herein by reference. Also, U.S. Reissue Pat. No. 29,948 describing and claiming a crystalline material with an X-ray diffraction pattern of ZSM-5 is incorporated herein by reference as is U.S. Pat. No. 4,061,724 describing a high silica ZSM-5 referred to as "silicalite" therein.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

ZSM-48 is more particularly described in U.S. Pat. No. 4,375,573, the entire contents of which are incorporated herein by reference.

Preferred shape selective medium pore crystalline silicate zeolite components of the mixed catalyst composition herein include ZSM-5, ZSM-11, ZSM-12, ZSM-23, ZSM-35, ZSM-38 and ZSM-48 with ZSM-5 being particularly preferred.

In general, the aluminosilicate zeolites are effectively employed herein. However, zeolites in which some other framework element which is present in partial or total substitution of aluminum can be advantageous. For example, such catalysts may provide a higher conversion of feed to aromatic components, the latter tending to increase the octane, and therefore the quality, of the gasoline produced in the process. Illustrative of elements which can be substituted for part or all of the framework aluminum are boron, gallium, titanium and any other trivalent metal which is heavier than aluminum. Specific examples of such catalysts include ZSM-5 and zeolite Beta containing boron, gallium and/or titanium. In lieu of, or in addition to, being incorporated into the zeolite framework, these and other catalytically active elements can also be deposited upon the zeolite by any suitable procedure, e.g., impregnation.

By appropriate selection of one or more characterizing physical properties, e.g., average particle size, density and/or geometry, it is possible to segregate, or separate, particles of first catalyst component from particles of second catalyst component in the reaction zone, the stripping zone or both zones. Thus, separation of particles of first catalyst component from those of second catalyst component in the stripping zone makes it possible to selectively transfer particles of first catalyst component, i.e., the one which requires frequent regeneration, to the regeneration zone and to cycle particles of second catalyst component, i.e., the one which is less coke deactivated than the first and requires relatively infrequent regeneration, to the reaction zone without going through the regeneration zone. Alternatively or in addition to such separation of the catalyst components in the stripping zone, it is also possible to arrange the physical properties of each catalyst component such that one of them will tend on the average to remain in the reaction zone longer than the other. For example, in accordance with this invention, one or more of the characterizing physical properties of each catalyst component can be such that the first catalyst component will possess a settling rate $R_1$ and the second catalyst component will possess a different settling rate $R_2$, the difference between $R_1$ and $R_2$ being such as to reduce the rate of circulation of the second catalyst component through the regeneration zone.

A variety of techniques can be used to bring about a differential in the settling rate of the catalyst components whereby the catalyst which is less coke deactivated is circulated less frequently through the regenerator than the catalyst requiring frequent regeneration. For example, the residency time of catalyst particles in a riser is primarily dependent on two factors: the linear velocity of the fluid stream within the riser which tends to carry the entire catalyst bed/conversion products/unconverted feed up and out of the riser into the separator unit and the opposing force of gravity which tends to keep the slower moving catalyst particles within the riser. Ordinarily, in a mixed catalyst system, both catalyst components will circulate through the system at about the same rate. As previously pointed out, this has proven disadvantageous to the efficiency of the system since the medium pore zeolite or other catalyst component which does not require as frequent regeneration as the cracking catalyst will be needlessly subjected to the catalyst-degrading conditions of the regenerator with the result that its useful catalytic life will be shortened. However, in accordance with this invention, it is possible to retain the less coke deactivated catalyst component within the riser, even to the point where, because of a balance between the upward velocity of this catalyst component and its settling rate, it can be made to remain more or less stationary, or suspended, at any desired level within the riser defining a zone of concentration therein. To bring about this balance or to otherwise prolong the residency time of a particular component of the mixed catalyst system within the riser, the average density, particle size and/or shape of the catalyst particles can be adjusted in a number of ways as to provide the desired settling characteristics. As a general guide, as the average particle size of the catalyst increases and/or its average particle density increases, the residency time of the catalyst will increase.

Longer residency time in the riser results in lower space velocity of the catalyst particle in the riser. When the catalyst particle is the second catalyst component of the invention, such as ZSM-5, the increased residency time and reduced space velocity, in the riser, has increased olefins, particularly, $C_3$ and $C_4$, production. Moreover, with such increased olefin production higher octane gains are achieved.

Among the techniques which can be used for making one catalyst component more dense than the other is compositing each catalyst with a matrix component of substantially different density. Useful matrix components include the following:

| matrix component | particle density (gm/cm$^3$) |
|---|---|
| alumina | 3.9–4.0 |
| silica | 2.2–2.6 |
| magnesia | 3.6 |
| beryllia | 3.0 |
| barium oxide | 5.7 |
| zirconia | 5.6–5.9 |
| titania | 4.3–4.9 |

Combinations of two or more of these and/or other suitable porous matrix components, e.g., silica-alumina, silica-magnesia, silica-thoria, silica-alumina-zirconia, etc., can be employed for a still wider spectrum of density values from which one may select a specific predetermined value as desired.

In general, selection of each matrix component will be such that the catalyst which is to have the lower rate of circulation through the regenerator will be significantly more dense than the catalyst requiring frequent regeneration. For example, in the case of a mixed catalyst system containing medium pore and large pore crystalline silicate zeolites where it is desired to increase the residency time of the medium pore zeolite catalyst in the riser, the overall packed density of the medium pore zeolite catalyst particles inclusive of its matrix component can advantageously vary from about 0.6 to about 4.0 gm/cm$^3$, and preferably from about 2.0 to about 3.0 gm/cm$^3$, and the overall packed density of the large pore zeolite catalyst particles inclusive of its matrix component can advantageously vary from about 0.4 to about 1.1 gm/cm$^3$ density, and preferably from about 0.6 to about 1.0 gm/cm$^3$.

Another useful technique for adjusting the density of each catalyst component, again in the case of a mixture of medium and large pore zeolite catalysts, is to composite the medium pore zeolite catalyst particles with a material which tends to coke up faster than the particles of large pore zeolite catalyst, such resulting in an increase in the density of the former in situ. Illustrative of such materials are hydrated alumina which in situ forms a transition alumina which has a high coking rate. This embodiment possesses several additional advantages. In the coked-up state, the composited medium pore silicate zeolite catalyst is more resistant to attrition which results from collision with other particles in the riser. The individual catalyst particles can sustain more collisions and thus serve as a practical means of adjusting the velocity of the large pore zeolite catalyst particles through the riser (the latter in colliding with the medium pore zeolite catalyst particles will, as a result, have reduced velocity). In addition, the coked-up composited medium pore zeolite catalyst particles will tend to accumulate metals present in the feed.

As previously stated, the relative settling rate of each catalyst component can be selected by varying the average particle size of the catalyst particles. This can be readily accomplished at the time of compositing the catalyst particles with various matrix components. As between two catalyst components of significantly different average particle size, the larger will tend to remain within the riser longer than the smaller. Where it is desired to increase the residency time, say, of the medium pore zeolite catalyst particles in the riser over that of the large pore zeolite catalyst component, the average particle size of the former will usually be larger than that of the latter. So, for example, the average particle size of the medium pore zeolite catalyst particles can be made to vary from about 500 microns to about 70,000 microns, and preferably from about 1000 to about 25,000 microns while the average particle size of the large pore zeolite catalyst particles can be made to vary from about 20 to about 150 microns, and preferably from about 50 to about 100 microns.

The shape, or geometric configuration, of the catalyst particles also affects their relative settling rates, the more irregular the shape (i.e., the more the shape deviates from a sphere), the longer the residency time of the particles in the riser. Irregular-shaped particles can be simply and readily achieved by crushing the catalyst-matrix extrudate or using an extruded catalyst.

As will be appreciated by those skilled in the art, the settling rate for a particular catalyst component will result from the interaction of each of the three foregoing factors, i.e., density, average particle size and particle shape. The factors can be combined in such a way that they each contribute to the desired result. For example, the particles of the less coke deactivated catalyst component can simultaneously be made denser, larger and more irregular in shape than the catalyst particles requiring frequent regeneration. However, a differential settling rate can still be provided even if one of the foregoing factors partially offsets another as would be the case where greater density and smaller average particle size coexist in the same catalyst particle. Regardless of how these factors of particle density, size and shape are established for a particular catalyst component, their combined effect will, of course, be such as to result in a significant differential in settling rates of the components comprising the mixed catalyst system of this invention.

By varying the cross sectional geometry of the riser, it is possible to further prolong the residency time therein of the denser, larger and/or more irregularly shaped catalyst particles. Numerous geometric configurations can be utilized to achieve this effect. So, for example, the riser can be made to flare outwardly for a part of its length. In one such arrangement, some portion of the upper section of the riser can be flared outwardly. The denser, larger and/or more irregularly shaped catalyst particles will tend to occupy the flared region of the riser as to constitute a zone of concentration therein.

The shape selective medium pore crystalline silicate zeolite catalyst can be present in the mixed catalyst system over widely varying levels. For example, the zeolite in the second catalyst component can be present at a level as low as about 0.01 to about 1.0 weight percent of the total catalyst inventory (as in the case of the catalytic cracking process of U.S. Pat. No. 4,368,114) and can represent as much as 25 weight percent of the total catalyst system.

The catalytic cracking unit is preferably operated under fluidized flow conditions at a temperature within the range of from about 900° F. to about 1350° F., a first catalyst component to charge stock ratio of from about 2:1 to about 15:1 and a first catalyst component contact time of from about 0.5 to about 30 seconds. Suitable charge stocks for cracking comprise the hydrocarbons generally and, in particular, petroleum fractions having an initial boiling point range of at least 400° F., a 50% point range of at least 500° F. and an end point range of at least 600° F. Such hydrocarbon fractions include gas oils, thermal oils, residual oils, cycle stocks, whole top crudes, tar sand oils, shale oils, synthetic fuels, heavy hydrocarbon fractions derived from the destructive hydrogenation of coal, tar, pitches, asphalts, hydrotreated feedstocks derived from any of the foregoing, and the like. As will be recognized, the distillation of higher boiling petroleum fractions above about 750° F. must be carried out under vacuum in order to avoid thermal cracking. The boiling temperatures utilized herein are expressed in terms of convenience of the boiling point corrected to atmospheric pressure.

Referring now to the Figure, a hydrocarbon feed 2 such as gas oil boiling at from about 600° F. up to about 1200° F. is conveyed following preheating to the bottom portion of riser 4 for admixture with hot regenerated catalyst, predominantly made up of zeolite Y, introduced by standpipe 6 provided with flow control valve 8. A suspension of catalyst in hydrocarbon vapors at a temperature of at least about 950° F., but more usually at a temperature of at least about 1000° F., is thus formed in the lower portion of riser 4 for flow upwardly therethrough under hydrocarbon conversion conditions. The suspension initially formed in the riser can be retained during flow through the riser for a first catalyst component residence time in the range of from about 0.5 to about 15 seconds.

Further up riser 4, the catalyst-hydrocarbon suspension encounters an outwardly flared region 5 which contains a large percentage of the ZSM-5 catalyst particles of the mixed catalyst system. The ZSM-5 catalyst particles occupying this region possess a combination of density, average particle size and shape such that the linear velocity of the suspension in this region which would tend to carry the ZSM-5 catalyst particles up and out of the riser is in approximate balance with the settling rate of these particles. Such being the case, the ZSM-5 catalyst particles, or at least the bulk of them, remain more or less stationary, or suspended, in region 5 of riser 4 where they catalyze a variety of other conversions involving the hydrocarbons present in this region including selective cracking to light olefins such as $C_{3-6}$ olefins, oligomerization, alkylation, isomerization, aromatization, etc., the result of which is to provide a gasoline product of increased RON and MON. Meanwhile, the particles of spent catalyst zeolite Y, being less dense, smaller and/or more regular in shape than the ZSM-5 particles, continue past region 5 together with the gasiform products of conversion and are ultimately discharged from the top of the riser into one or more cyclonic separation zones adjacent the riser discharge as represented by cyclone separator 14. There may be a plurality of such cyclone separator combinations comprising first and second cyclonic separation means attached to or spaced apart from the riser discharge for separating catalyst particles from hydrocarbon vapors. Separated hydrocarbon vapors are conveyed from separator 14 to a plenum chamber 16 for withdrawal therefrom by conduit 18. These hydrocarbon vapors together with gasiform material separated by stripping gas as defined below are passed by conduit 18 to fractionation equipment (not shown). Spent zeolite Y catalyst particles separated from hydrocarbon vapors in the cyclonic separation means is passed by diplegs represented by dipleg 20 to a dense fluid bed of separated catalyst 22. Catalyst bed 22 is maintained as a downwardly moving fluid bed of catalyst countercurrent to rising gasiform material. The catalyst passes downwardly through a stripping zone 24 immediately therebelow and countercurrent to rising stripping gas introduced to a lower portion thereof by conduit 26. Baffles 28 are provided in the stripping zone to improve the stripping operation.

The spent catalyst is maintained in stripping zone 24 for a period of time sufficient to effect a higher temperature desorption of feed-deposited compounds which are then carried overhead by the stripping gas. The stripping gas with desorbed hydrocarbons passes through one or more cyclonic separating means 32 wherein entrained catalyst fines are separated and returned to catalyst bed 22 by dipleg 34. Riser 4 may terminate in an upper enlarged portion of the catalyst collecting vessel with the commonly known bird cage discharge device or an open end "T" connection may be fastened to the riser discharge which is not directly connected to the cyclonic catalyst separation means. The cyclonic separation means may be spaced apart from the riser discharge so that an initial catalyst separation is effected by a change in velocity and direction of the discharged suspension so that vapors less encumbered with catalyst fines may then pass through one or more cyclonic separation means before passing to a product separation step. In any of these arrangements, gasiform materials comprising stripping gas, hydrocarbon vapors and desorbed sulfur compounds are passed from the cyclonic separation means represented by separator 32 to a plenum chamber 16 for removal with hydrocarbon products of the cracking operation by conduit 18. Gasiform material comprising hydrocarbon vapors is passed by conduit 18 to a product fractionation step not shown. Hot, stripped spent zeolite Y catalyst particles at an elevated temperature is withdrawn from a lower portion of the stripping zone by conduit 36 provided with valve 38 for transfer to a fluid bed, zeolite Y being regenerated in a catalyst regeneration zone.

Spent zeolite Y catalyst particles attain a relatively high level of hydrocarbonaceous material which is subsequently removed therefrom by regeneration with oxygen-containing regeneration gases. The stripped catalyst particles are passed by conduit 36 provided with flow control valve 38 to a catalyst regeneration unit represented by regenerator 46 containing a dense fluid bed of catalyst 48. Regeneration gas such as air is introduced to the lower portion of regenerator 46 by air distributor 50 supplied by conduit 52. Cyclone separators 54 provided with diplegs 56 separate entrained catalyst particles from flue gases and return the separated catalyst to the fluid bed of catalyst. Flue gases pass from the cyclones into a plenum chamber and are removed therefrom by conduit 58. Hot regenerated zeolite Y catalyst is returned to the bottom of riser 4 by conduit 6 as discussed above to participate in another cycle of conversion From the foregoing, it will be appreciated that due to their ability to reside in riser 4 as a somewhat stationary, or suspended, zone of concentration in region 5 thereof, the ZSM-5 catalyst particles circulate through regenerator unit 46 far less frequently than the spent zeolite Y catalyst particles. As a result, the ZSM-5 catalyst particles are retained in the catalyst inventory at a relatively high level of activity therein for a longer average period of time than would be the case were the settling rate of the particles the same as, or similar to, that of the zeolite Y catalyst particles.

Having thus provided a general discussion of the present invention and described specific embodiments in support thereof, it is to be understood that no undue restrictions are to be imposed by reason thereof except as provided by the following claims.

What is claimed is:

1. A method for providing a catalyst system for a catalytic conversion process which comprises:

(a) introducing to a cracking zone of a catalytic conversion process particles of a first, catalyst component which requires frequent regeneration in a catalyst regeneration zone and, wherein the characterizing physical properties of the first catalyst component are such as to impart a settling rate $R_1$ thereto (b) introducing to said cracking zone particles of a second catalyst component which is less coke deactivated than the first catalyst component and requires less frequent regeneration than the latter, wherein the second catalyst component is composited with a matrix material which possesses a coking rate which is higher than the coking rate of the first catalyst component, and wherein the second catalyst component has a settling rate $R_2$, said $R_2$ being different from $R_1$;

wherein characterizing physical properties of the first catalyst component are such as to impart said settling rate $R_1$ thereto and characterizing physical properties of the second catalyst component are such as to impart a different settling $R_2$ thereto, there being a sufficient difference between $R_1$ and $R_2$ that the rate of circulation of the second catalyst component through the cracking zone is less than that of the first catalyst component, wherein said characterizing physical properties is at least one property selected from the group consisting of average particle size; density; and particle shape.

2. The method of claim 1 wherein the first catalyst component is at least one large pore crystalline silicate zeolite cracking catalyst and the second catalyst component is zeolite Beta.

3. The method of claim 2 wherein the zeolite beta contains a framework other than aluminum.

4. The method of claim 1 wherein the first catalyst component contains at least one member of the group consisting of zeolite X, Y, REY, USY, RE-USY, mordenite and mixtures thereof and the second catalyst component comprises zeolite Beta.

5. The method of claim 4 wherein the zeolite beta contains a framework element other than aluminum.

6. The method of claim 1 wherein the first catalyst component is at least one member of the group consisting of amorphous cracking catalyst and large pore crystalline silicate cracking catalyst and the second catalyst component contains a shape selective medium pore crystalline silicate zeolite.

7. The method of claim 6 wherein the shape selective medium pore crystalline silicate zeolite is at least one member of the group consisting of ZSM-5, ZSM-11, ZSM-12, ZSM-23, ZSM-35, ZSM-38 and ZSM-48.

8. The method of claim 7 wherein the shape selective medium pore crystalline silicate zeolite contains at least one catalytically active element deposited thereon.

9. The method of claim 7 wherein the shape selective medium pore crystalline silicate contains at least one framework element other than aluminum.

10. The method of claim 1 wherein the first catalyst component contains at least one large pore crystalline silicate zeolite cracking catalyst and the second catalyst component contains a shape selective medium pore crystalline silicate zeolite.

11. The method of claim 10 wherein the shape selective medium pore crystalline silicate zeolite is at least one member of the group consisting of ZSM-5, ZSM-11, ZSM-12, ZSM-23, ZSM-35, ZSM-38 and ZSM-48.

12. The method of claim 11 wherein the shape selective medium pore crystalline silicate zeolite contains at least one catalytically active element deposited thereon.

13. The method of claim 11 wherein the shape selective medium pore crystalline silicate contains at least one framework element other than aluminum.

14. The method of claim 1 wherein the first catalyst component contains at least one member of the group consisting of zeolite X, Y, REY, USY, RE-USY, mordenite and mixtures thereof and the second catalyst component contains a shape selective medium pore crystalline silicate zeolite.

15. The method of claim 14 wherein the shape selective medium pore crystalline silicate zeolite is at least one member of the group consisting of ZSM-5, ZSM-11 ZSM-12, ZSM-23, ZSM-35, ZSM-38 and ZSM-48.

16. The method of claim 15 wherein the shape selective medium pore crystalline silicate zeolite contains at least one framework element other than aluminum in partial or total substitution for aluminum.

17. The method of claim 2 wherein the average particle size of the second catalyst component is larger than the average particle size of the first catalyst component.

18. The method of claim 2 wherein the density of the second catalyst component is larger than the density of the first catalyst component.

19. The method of claim 2 wherein the shape of the second catalyst component particles is different from the shape of the first catalyst component particles.

20. The method of claim 17 wherein the average particle size of the first catalyst component ranges from about 20 to about 150 microns and the average particle size of the second catalyst component ranges from about 500 to about 70,000 microns.

21. The method of claim 18 wherein the average packed density of the first catalyst component ranges from about 0.6 to about 1.0 $gm/cm^3$ and the average packed density of the second catalyst component ranges from about 2.0 to about 3.0 $gm/cm^3$.

22. The method of claim 1 wherein the second catalyst component is composited with a matrix material which imparts a density to said second catalyst component which is greater than the density of the first catalyst component.

23. The method of claim 1 wherein the catalytic conversion process is catalytic cracking.

24. A cracking catalyst system for a fluid catalytic cracking zone which comprises particles of a first catalyst component which requires frequent regeneration in a catalyst regenerator; and particles of a second catalyst component which requires less frequent regeneration than said first catalyst component which second catalyst component is composited with a matrix material, which possesses a coking rate which is higher than the coking rate of the first catalyst component, wherein said second catalyst component is less coke deactivated and wherein a physical property of particles of the first catalyst component imparts a settling rate $R_1$ thereto and a physical property of particles of the second catalyst component imparts a different settling rate $R_2$ thereto;

wherein a difference between $R_1$ and $R_2$ is effective to cause the residence time of the second catalyst component in the fluid catalytic cracking zone to be greater than that of the first catalyst component.

25. The catalyst system of claim 24, wherein the difference between $R_1$ and $R_2$ is further effective to cause the rate of circulation of the second catalyst component through a regenerator to be less than that of the first catalyst system.

* * * * *

UNITED STATES PATENT AND TRADEMARK OFFICE

CERTIFICATE OF CORRECTION

PATENT NO. : 4,861,741

DATED : August 29, 1989

INVENTOR(S) : Joseph A. Herbst, Hartley Owen and Paul H. Schipper

It is certified that error appears in the above-identified patent and that said Letters Patent is hereby corrected as shown below:

Col. 6, Line 34 after "has" add -- several practical advantages. Reduced effective space velocity results in --

Col. 11, Line 11 add -- element -- after framework

Col. 12, Line 44 after "deactivated", add -- than the first catalyst component --

Signed and Sealed this

Thirty-first Day of March, 1992

*Attest:*

*Attesting Officer*

HARRY F. MANBECK, JR.

*Commissioner of Patents and Trademarks*